US011891734B2

(12) United States Patent
Strohmaier

(10) Patent No.: US 11,891,734 B2
(45) Date of Patent: Feb. 6, 2024

(54) COMPOUND NEEDLE FOR KNITTING MACHINES

(71) Applicant: Groz-Beckert KG, Albstadt (DE)

(72) Inventor: Marc Johannes Strohmaier, Fridingen (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 17/922,009

(22) PCT Filed: Feb. 3, 2021

(86) PCT No.: PCT/EP2021/052525
§ 371 (c)(1),
(2) Date: Oct. 28, 2022

(87) PCT Pub. No.: WO2021/219261
PCT Pub. Date: Nov. 4, 2021

(65) Prior Publication Data

US 2023/0122532 A1 Apr. 20, 2023

(30) Foreign Application Priority Data

Apr. 29, 2020 (EP) ..... 20172077

(51) Int. Cl.
*D04B 35/06* (2006.01)

(52) U.S. Cl.
CPC ..... *D04B 35/06* (2013.01)

(58) Field of Classification Search
USPC ..... 66/116, 120
See application file for complete search history.

(56) References Cited

U.S. PATENT DOCUMENTS 1,435,714 A * 11/1922 La Montagne ..... D04B 35/06 66/120
1,435,715 A * 11/1922 La Montagne ..... D04B 35/06 66/120

(Continued)

FOREIGN PATENT DOCUMENTS

CN 1724738 A 1/2006
CN 104928841 A 9/2015

(Continued)

OTHER PUBLICATIONS

International Search Report for PCT/EP2021/052525 dated Mar. 17, 2021; 5 pages.

(Continued)

*Primary Examiner* — Aiying Zhao
(74) *Attorney, Agent, or Firm* — Fitch, Even, Tabin & Flannery LLP

(57) ABSTRACT

A compound needle (13) for knitting machines, which is optimised in respect of stiffness, strength and service life and whose needle (1) has at least one hole (7) with which a functional element (8) of the slider (2) engages when the slider (2) is in its working portion (24). The functional element (8) connects operatively in such a way with the hole (7) in the needle (1) that it limits the freedom of movement of the slider (2) relative to the needle (1) to the slider's working portion (24)—i.e. prevents the slider from leaving the working portion (24) at the position of the functional element (8).

14 Claims, 5 Drawing Sheets

(56) References Cited

U.S. PATENT DOCUMENTS

| | | | | |
|---|---|---|---|---|
| 6,568,223 | B1 * | 5/2003 | Morita | D04B 35/06 66/123 |
| 2002/0112509 | A1 * | 8/2002 | Baseggio | D04B 35/06 66/120 |
| 2008/0307832 | A1 * | 12/2008 | Weihing | D04B 35/06 66/120 |
| 2013/0091901 | A1 * | 4/2013 | Schneider | D04B 35/06 66/120 |
| 2019/0276957 | A1 | 9/2019 | Hofmann | |

FOREIGN PATENT DOCUMENTS

| | | | | |
|---|---|---|---|---|
| CN | 109957881 | A | 7/2019 | |
| DE | 4446952 | A1 | 6/1995 | |
| EP | 1233093 | B1 | 8/2002 | |
| EP | 1640489 | A1 * | 3/2006 | D04B 35/06 |
| EP | 2581480 | A | 4/2013 | |
| GB | 156405 | A * | 1/1921 | D04B 35/06 |
| GB | 156405 | A | 1/1921 | |
| JP | S626392 | U | 1/1987 | |
| JP | H07197359 | A | 8/1995 | |

OTHER PUBLICATIONS

International Report on Patentability for PCT/EP2021/052525 dated Mar. 31, 2022; 22 pages.

National Intellectual Property Administration, P.R. China, Office Action for CN Application No. 202180031719.X, dated Mar. 13, 2023; 12 pages.

National Intellectual Property Administration P.R. China, Office Action in corresponding CN Application No. 202180031719.X dated Mar. 17, 2023; 17 pages.

European Patent Office; European Search Report in corresponding European Patent Application No. 20172077.8 dated Oct. 28, 2020; 18 pages.

International Search Report for PCT/EP2021/052525 dated Mar. 17, 2021; 29 pages.

* cited by examiner

A - A

COMPOUND NEEDLE FOR KNITTING MACHINES

CROSS REFERENCE TO RELATED APPLICATIONS

This patent application is the national phase of PCT/EP2021/052525, filed Feb. 3, 2021, which claims the benefit of European Patent Application No. 20172077.8, filed Apr. 29, 2020.

BACKGROUND

A variety of loop-forming needles for industrial knitting machines is known. Loop-forming needles typically include a hook and a device serving to open and close a hook—or the interior thereof. Multi-component compound needles comprising at least a needle member and a slider, which extend predominantly in a needle's longitudinal direction, constitute a special form of loop-forming needle. In this case, the slider is adapted to the needle in such a way that, during relative movement between needle and slider for the purpose of loop formation, the slider is only able to move within a given working portion. The slider's working portion is the portion in which the slider moves relative to the needle during the knitting process. It is determined by the design of needle and slider. Relative movement between slider and needle in the needle's longitudinal and/or height direction is thereby limited. At its front end, the slider additionally has a closing lip that can carry a loop and, by means of the relative movement, can open and close the hook. Various shapes of lip are known and conceivable. In this publication, the term "closing lip" is accordingly used in a functional sense: the "closing lip" is that part of the slider which, irrespective of its shape, closes the hook.

The needle has a fork comprising at least two fork arms. These are mutually offset in the needle's height direction and extend beside each other in the needle's longitudinal direction. At least one of the fork arms—preferably the lower—carries the needle's hook. During relative movement between slider and needle, at least one of the fork arms (often both) serve as guiding element for the slider by keeping the slider within its working portion. The working portion is the portion in which the slider can be located relative to the needle during maximum relative movement between needle and slider in the needle's longitudinal and height directions. Additionally, the slider has at least one functional element which connects operatively with the needle and which, during relative movement between needle and slider, keeps the slider within its working portion relative to the needle.

GB 156405A shows a compound needle, which has a recess at its lower surface and which is in operation connection with a U-shaped portion of a slider. By targeted design of of length of this U-shaped portion, the slider is secured so that it can move upward, forward and backward only within certain limits. However, the engagement of the U-shaped portion in the recess does not limit the downward movement of the slider. Furthermore, the needle does not have a fork.

EP2581480A1 shows a compound needle which has a fork. A recess is arranged between the fork arms of the fork. When the slider moves backwards relative to the needle in the longitudinal direction a curved portion of the slider engages in this recess. The contact between the curved portion and the bounding surfaces of the recess is intended to initiate a lowering of the sinker. However, the curved portion is not guided in the fork during most of the relative movement between the slider and the needle.

A compound needle with a fork is described in EP1233093B1. At its rear end, the slider has a functional element in the form of a bearing point that interacts with the needle in such a manner as to prevent the slider from leaving its working portion by means of rocking. For this purpose, the slider embraces the needle over its entire height in the area of the bearing point.

In recent years, knitting speeds of new knitting machines have increased. Requirements pertaining to the strength, rigidity and service life of compound needles have increased accordingly.

One objective of the invention is therefore to provide a compound needle which has better stiffness and strength properties and a longer service life without requiring additional installation space.

SUMMARY

This objective can be achieved by means of a compound needle having the features described herein and said needle additionally having at least one hole with which at least one functional element of the slider engages when the slider is within its working portion. A functional element which connects operatively with the hole in such a way as to limit the slider's freedom of movement relative to the needle to its working portion—i.e. which prevents the slider from leaving the working portion at the position of the functional element—is advantageous. An oblong hole extending substantially in the needle's longitudinal direction is to advantage.

The hole comprises an areal recess in the plane defined by the needle's longitudinal direction and the needle's height direction, and reaches into the needle shank in the needle's width direction. The hole's boundary with the surface of the needle shank is uninterrupted. It is beneficial, but not necessary, for the surface of the needle shank to have the same position, in the needle's width direction, along this boundary. Advantageously, the hole is an oblong hole reaching right through the needle shank or is a groove that only partially penetrates the needle shank in its width direction, in the form of a blind hole. It is to advantage if the lengthwise extension of the groove or oblong hole is substantially in the needle's longitudinal direction. In this way, the shape of the hole allows the functional element to move relative to the needle within the hole. Further advantages are obtained if the hole's dimension in the needle's longitudinal direction is coordinated with the length of the relative movement between needle and slider in the needle's longitudinal direction during knitting. It is particularly beneficial if the hole extends in the needle's longitudinal direction for a distance which corresponds at least to, or is the same as, the maximum distance which the slider moves relative to the needle in the needle's longitudinal direction. In this way, the edges of the hole which delimit the hole in the needle's longitudinal direction can serve as a stop for the functional element and limit the relative movement during knitting between needle and slider, optionally in both directions (position furthest towards the tip of the slider and/or position furthest towards the needle butt).

It is advantageous if the upper belt and/or the lower belt of the hole are tapered relative to the other of the two belts or relative to the entire remainder of the needle shank. If this is the case, functional elements that are pressed into their working position in the hole via spring tension can be installed in their working position more easily during assembly via the tapered belt. In this way, furthermore, functional elements are able to embrace the needle shank at the position of the tapered belt without increasing the installation space of the compound needle (particularly in the needle's width direction). The lower belt's maximum cross-sectional area, which is parallel to the plane defined by the needle's height direction and the needle's width direction, is preferably larger than the upper belt's maximum cross-sectional area in the same plane. It is furthermore advantageous if the undermost bounding surface of the lower belt is simultaneously the needle's undermost bounding surface in the needle's height direction or runs on a plane with the needle's undermost bounding surface.

An advantageous way of providing at least one functional element consists in the following measure: at the position of its working portion, the slider is provided with skirts which either embrace the needle shank or slide in a groove therein. The slider skirts are often made of material having sheet-metal properties. A tab made of such material and attached to one of these skirts can be aligned by bending such that, in the aforementioned operational position, it engages the hole in the needle shank. As a rule, the skirts are likely to extend substantially along the plane defined by the needle's longitudinal direction and the needle's height direction. In this embodiment, the bent tab is the functional element and will point substantially in the needle's width direction. The bending process produces a radius between the skirt and the tip of the tab. A tab having at least one notch at the transition to the slider's skirt is particularly advantageous. It facilitates forcing the tabs apart during mounting of the slider on the needle. At least one functional element, however, may also be configured as a cylindrical stud, the axis of which runs in the needle's width direction. The stud may be formed from slider material—i.e. integrally with the slider—or be attached in arbitrary manner to a slider skirt, to a tab thereof or to another component of the slider. Thermal joining methods, such as spot-welding, or form-locking joining methods, such as riveting, are advantageous. As a rule, the guiding element is that component of the slider that engages the hole in the needle's width direction.

It is furthermore advantageous if the slider has at least two functional elements. A beneficial way of arranging two such functional elements consists in that, in their operational position, they are "in opposition" relative to the needle shank or the hole in the needle shank. By this is meant that, at least at the position of the functional elements, the needle slider is symmetrically constructed and that one functional element from each side engages a hole in the needle's width direction. It is to advantage if the functional elements are located at the same distance along the length of the needle. This enables implementation of this teaching when the needle shank is provided with only one through hole. The functional elements then engage the hole, in the needle's longitudinal direction, from both sides in opposite directions.

Use of the teaching according to the invention provides special advantages in knitting machines whose knitting elements are not driven by stitches but by knitting-machine devices via mechanical elements such as needle butts, because here the higher stability of the needles and sliders according to the invention is particularly beneficial.

It is advantageous to arrange the fork and the hole in the needle in such a way that the lengthwise portions of the needle taken up by the fork and the hole do not overlap. It is particularly advantageous if a gap exists between the end of the lengthwise portion of the needle taken up by the fork and the start of the lengthwise portion of the needle taken up by the hole. A particularly advantageous gap is one which measures at least as much in the needle's longitudinal direction as the maximum dimension of the upper fork arm in the needle's height direction. However, the greater this gap in the needle's longitudinal direction is, the better the functional element is able to support rocking movements of the slider.

DETAILED DESCRIPTION

Figure 2:
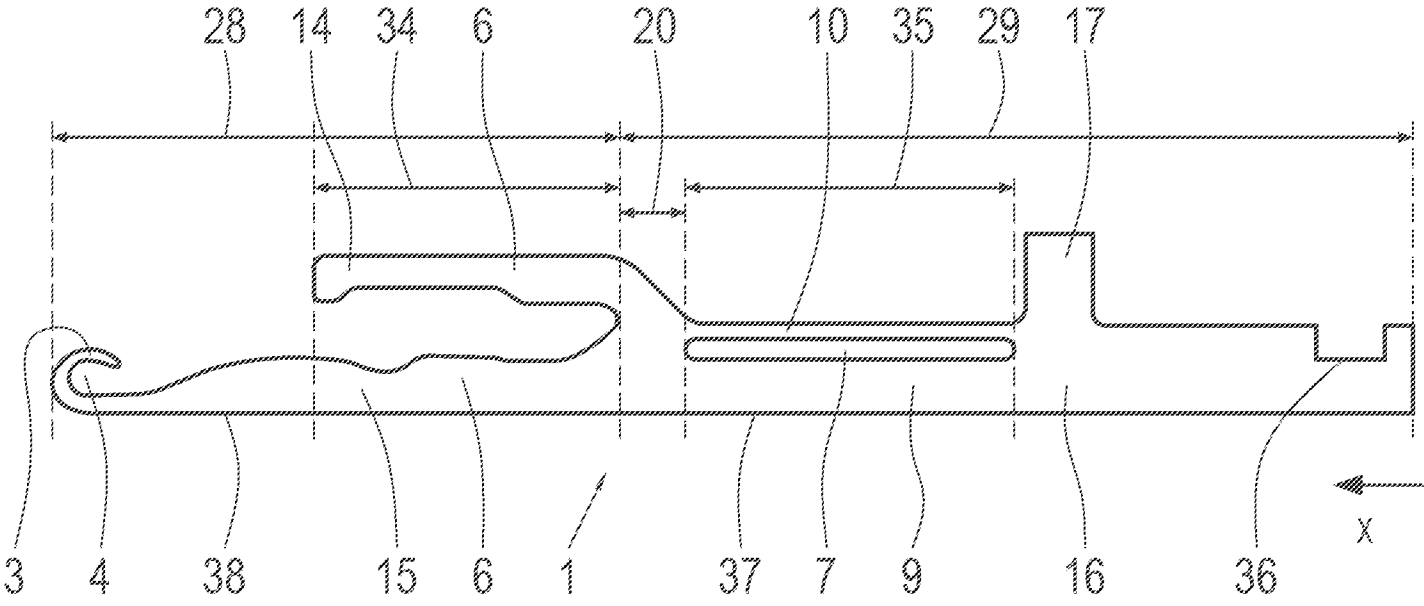
FIG. 2 shows a needle 1 of the compound needle 13.

FIG. 2 shows the needle 1 of the compound needle 13. The needle 1 has a hook 3 with a hook interior 4. In addition, the needle 1 has a fork 6 with fork arms 14 and 15. Further along the needle shank 16 of the needle 1 in the needle's longitudinal direction x, towards the needle butt 17, is the hole 7, which is oblong in shape. It is evident from FIG. 2 that the fork arms 14 and 15 are in a forward portion 28 of the needle 1, while the hole 7 is in a rearward portion 29 of the needle 1. In this case there is no overlapping, in the needle's longitudinal direction x, of the portion 34 taken up by the fork 6 and the portion 35 taken up by the hole 7. It must also be mentioned that these drawings are not to scale and that, in particular, the dimensions of the needle 1 in it's longitudinal direction x are comparatively too small. It may be noted, therefore, that for all embodiments of the invention, it may be advantageous if there is no overlapping, in the needle's longitudinal direction x, between the start of the lengthwise portion 34 taken up by the fork arms 14 and 15 and the lengthwise portion 35 taken up by the hole 7.

Figure 1:
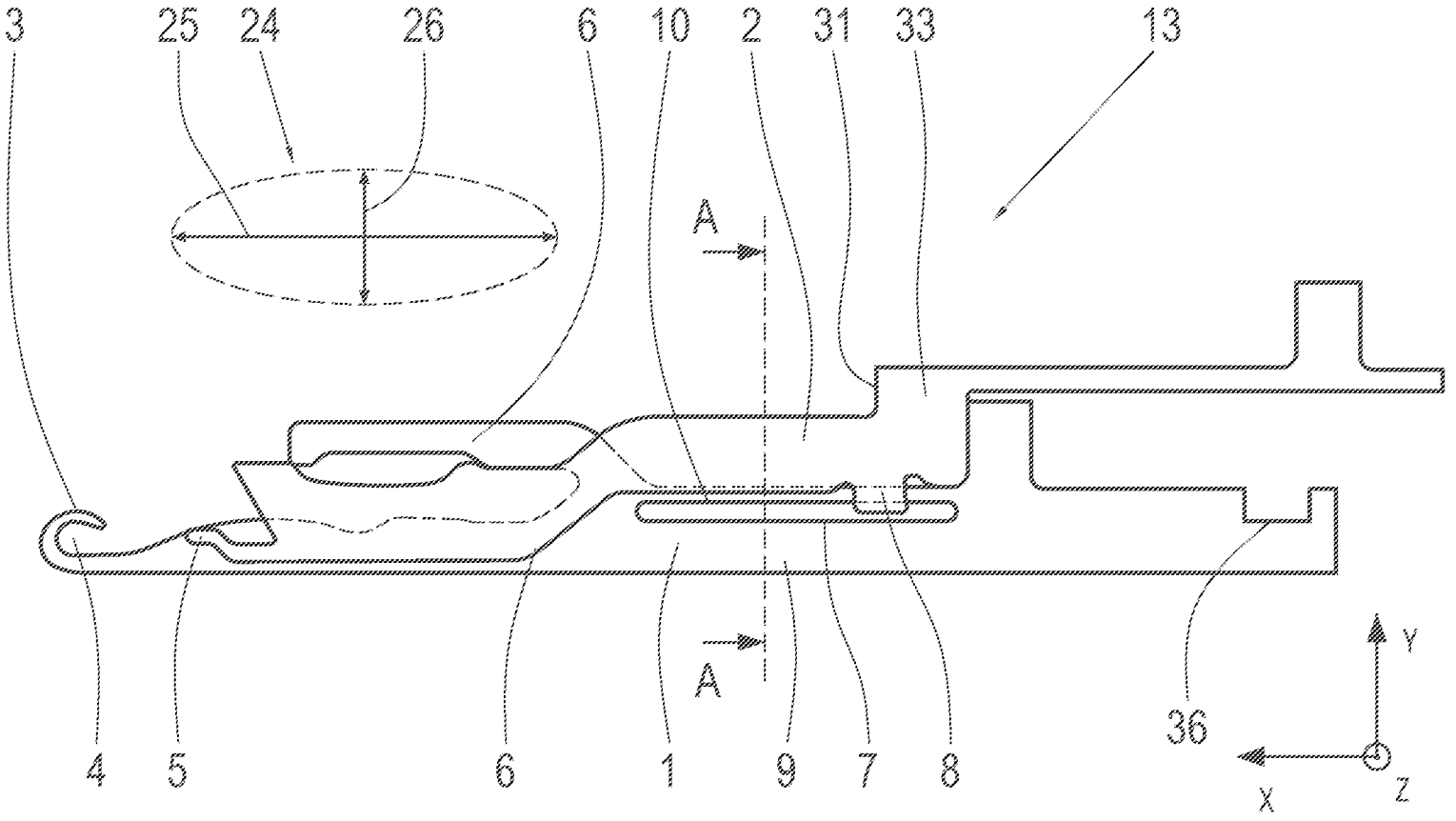
FIG. 1 shows a compound needle 13 in the assembled state.

Additional advantages are obtained for all embodiments of the invention if a gap 20 exists, in the needle's longitudinal direction x, between the portion 35 taken up by the hole 7 and the portion 34 taken up by the fork 6, i.e. if the two aforementioned portions 34 and 35 are spaced mutually apart. This gap 20 is advantageously at least as large, in the needle's longitudinal direction x, as the maximum height of the upper fork arm 14. FIGS. 1 and 2 also show the coupling 36 for a further control or drive member that may be used there. It is the intention to indicate in this way that needles 1, or compound needles 13 according to the invention, are also excellently suited for use in more complex knitting machines having such additional control or drive members. It is also evident from FIG. 2 that the undermost bounding surface 37 of the lower belt 9 is the same height, in the needle's height direction y, as the undermost bounding surface 38 of the needle 1 in this direction, i.e. that the needle 1 has a continuous undermost bounding surface of which the undermost bounding surface 37 of the lower belt 9 is a part. As a rule, the needle 1 slides on this bounding surface, in its needle slot, during knitting. This feature is advantageous for all the embodiments of the invention because the effect thereof is that the available installation space or working space for the needle 1 is utilised optimally to stabilise stabilising the needle 1.

Figure 3:
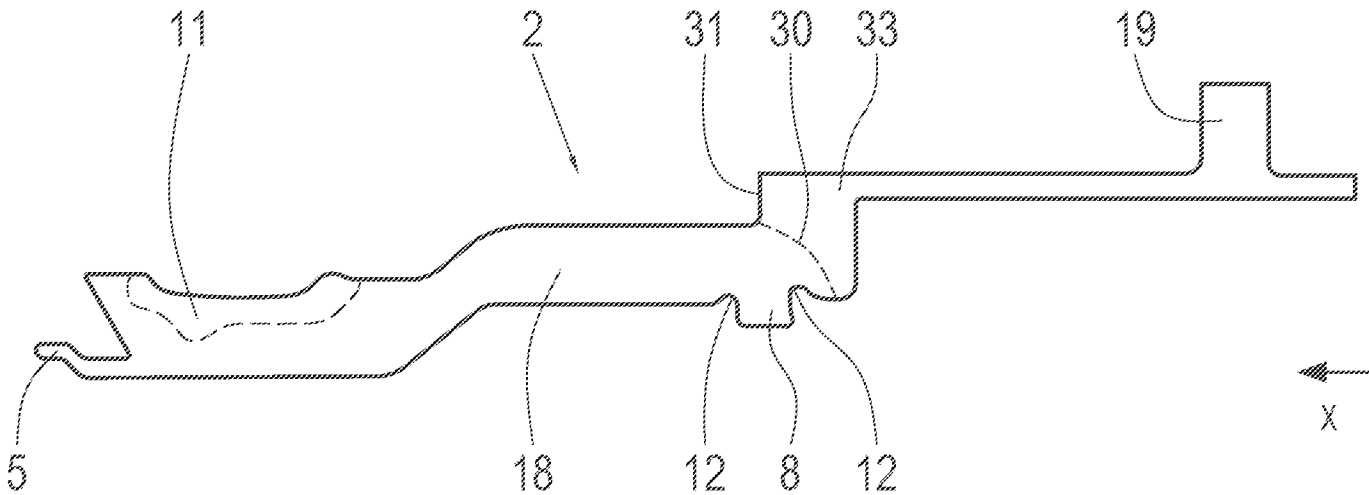
FIG. 3 shows a slider 2 of the compound needle 13.

FIG. 3 shows the slider 2. This has a closing lip 5, which is able to close off the hook interior 4 during knitting. The numeral 11 designates the carriage portion of the slider 2. In its operational position, it slides along the lower surface of the fork arm 14 and/or the upper surface of the fork arm 15. The broken line delimiting the carriage 11 from the rest of the slider 2 merely indicates that the carriage 11 consists of solid material. The front surface 30 of the drive bar 33, said surface facing the slider interior, is also shown as a broken line in order to indicate the transition from the skirts 18 to the drive bar 33, which consists of solid material. The functional element 8 is delimited from the skirt 18 of the slider 2 by two notches 12. The slider 2 also has a butt 19, via which the slider 2 obtains its moving force. FIG. 1 shows needle 1 and slider 2 in the assembled state. The broken lines in FIG. 1 outline parts of the needle 1 obscured by the slider 2. The working portion 24 of the slider 2 on the needle 1 is indicated by the broken oval in FIG. 1: the arrows 25 and 26 are seen here, which stand for the direction and amount of relative movement between needle 1 and slider 2 in the needle's longitudinal direction x and in the needle's height direction y within the working portion 24. The relative movements performed during knitting by a generic slider 2 within its working portion 24 are complex, but are known to persons skilled in the art and are exemplified in the aforementioned DE 602 07454 T2 (EP1233093B1).

Figure 4:
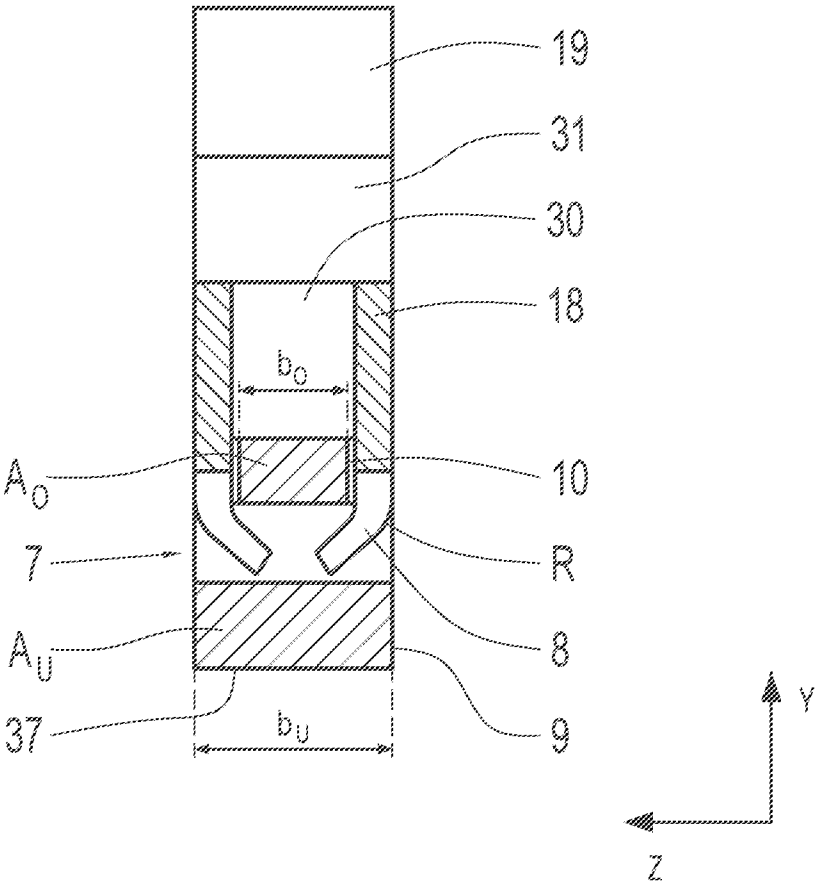
FIG. 4 shows the A-A section through FIG. 1.
Figure 5:
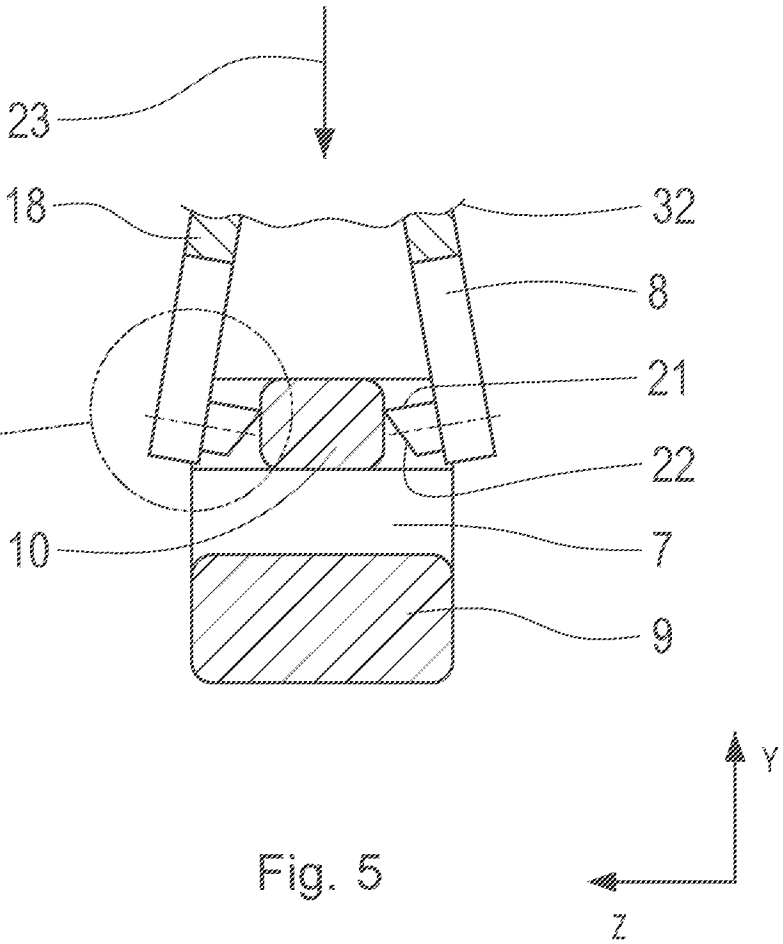
FIG. 5 shows an equivalent section through an embodiment of a compound needle 13 according to the invention and having a cylindrical pin 21 while the slider 2 is being moved, in the direction of arrow 23, into its operational position.

FIG. 4 shows the section A-A from FIG. 1 and thus shows the different widths $b_o$ of the upper belt 10 and $b_u$ of the lower belt 9. It is also evident from FIG. 4 that the tab 8 has ends which are bent in the needle's width direction z (thereby forming the radius R) in such a way that they engage the hole 7. The skirts 18 are connected to the drive bar 33 (see FIGS. 1 and 3). In the background of the section A-A, the shoulder 31 of the drive bar 33 of the slider 2 and (further behind) the slider butt 19 are visible. Between the skirts 18 and facing the slider interior is the front surface 30 of the drive bar 33. The curved course of the surface is shown in FIG. 3. The functional reason for the smaller width bo of the upper belt 10 compared to the width $b_u$ of the lower belt 9 becomes clear from FIG. 5: FIG. 5 shows a detail, below the break line 32, of a sectional view comparable to that of FIG. 4 through a somewhat different embodiment of a compound needle 13 according to the invention. In this case, the slider 2 has tabs 8, each of which is provided with a cylindrical stud 21. During the assembly movement in assembly direction 23, with which the slider 2 is mounted on the needle 1, the tabs 8 are forced further apart. The smaller width of the upper belt 10, on which the elements 8 are forced apart, facilitates the assembly process. In FIG. 5, the assembly process is facilitated additionally by the fact that the surface 22 of the cylindrical stud 21, which surface 22 faces the surface of the upper belt 10 during the assembly movement, is inclined away from the plane defined by the needle's longitudinal direction x and the needle's height direction y by an assembly angle 27 when the stud is in the operative position (see FIG. 6).

Figure 6:
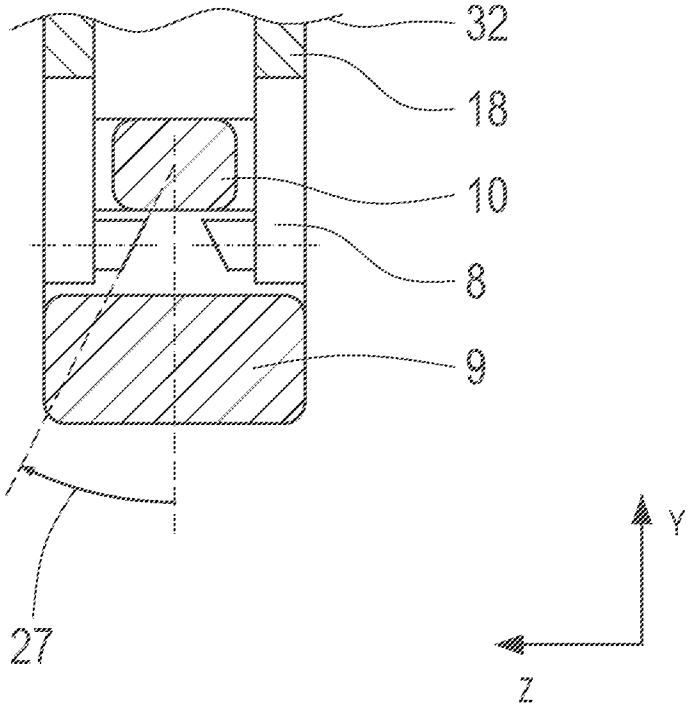
FIG. 6 shows the sectional view of FIG. 5 with the slider 2 in its operational position.

FIG. 6, finally, shows the same detail of the same section through the same embodiment of a compound needle 13 according to the invention as FIG. 5 after the slider 2, moving in the assembly direction 23, has reached its end position and the cylindrical studs 21 have engaged the hole 7.

Figure 7:
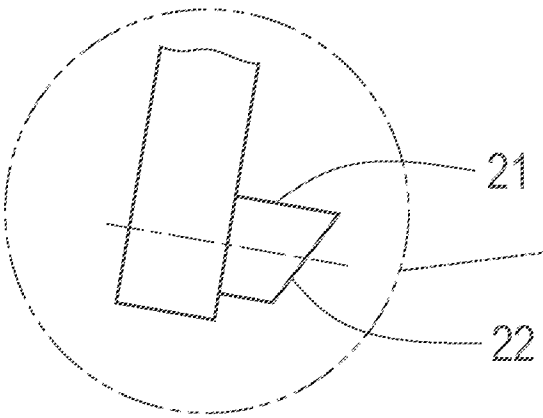
FIG. 7 is an enlarged detail from FIG. 5.

FIG. 7 shows the cylindrical stud 21 again, with its surface 22, as an enlarged detail. FIGS. 4, 5 and 6 also show that, in the plane defined by the height y and width z coordinates of the needle 1, the cross-sectional area Ao of the upper belt 10 is smaller or the same as the cross-sectional area Au of the lower belt 9 in the plane defined by the height direction y and the width direction z of the needle 1. This feature, too, brings further advantages for all the embodiments of the invention.

List of reference numerals

| | |
|---|---|
| 1 | Needle |
| 2 | Slider |
| 3 | Hook |
| 4 | Hook interior |
| 5 | Closing lip of slider 2 |
| 6 | Fork of needle 1 |
| 7 | Hole |
| 8 | Projection/Functional element |
| 9 | Lower belt |
| 10 | Upper belt |
| 11 | Carriage portion of slider 2 |
| 12 | Notches in the skirt 18 of slider 2 |
| 13 | Compound needle |
| 14 | Upper fork arm of needle 1 |
| 15 | Lower fork arm of needle 1 |
| 16 | Needle shank |
| 17 | Needle butt |
| 18 | Skirt of slider 2 |
| 19 | Slider butt |
| 20 | Gap in longitudinal direction x between the fork 6 and the hole 7 |
| 21 | Cylindrical stud/Alternative functional element |
| 22 | Surface of cylindrical stud 21 facing the surface of upper belt 10 |
| 23 | Arrow in assembly direction of slider 2 |
| 24 | Working portion |
| 25 | Maximum relative movement between needle 1 and slider 2 in the needle's longitudinal direction x |
| 26 | Maximum relative movement between needle 1 and slider 2 in the needle's height direction y |
| 27 | Assembly angle |
| 28 | Forward needle portion |
| 29 | Rearward needle portion |
| 30 | Front surface of the control/drive bar 33, facing the slider interior |
| 31 | Shoulder of control/drive bar 33 |
| 32 | Break line |
| 33 | Control/drive bar |
| 34 | Portion taken up by the fork 6 in the needle's longitudinal direction x |
| 35 | Portion taken up by the hole 7 in the needle's longitudinal direction x |
| 36 | Coupling for a control member |
| 37 | Undermost bounding surface of belt 9 in the needle's height direction y |
| 38 | Undermost bounding surface of needle 1 in the needle's height direction y |
| x | Needle's longitudinal direction |
| y | Needle's height direction |
| z | Needle's width direction |
| $b_O$ | Width of upper belt 10 in the needle's width direction z |
| $b_U$ | Width of lower belt 9 in the needle's width direction z |
| $A_O$ | Cross-sectional area of upper belt 10 in the y-z plane |
| $A_U$ | Cross-sectional area of lower belt 9 in the y-z plane |

The invention claimed is:

1. A compound needle (13) for knitting machines, comprising:

a needle (1), which extends substantially in a longitudinal direction (x), the needle including a hook (3) at a front end thereof in the longitudinal direction (x), a slider (2) which extends substantially in the longitudinal direction (x), wherein the slider (2) is adapted to the needle (1) in such a way that relative movement between the needle (1) and the slider (2) is possible, and wherein the slider (2) has a closing lip (5) for closing the hook (3) of the needle (1), wherein the needle (1) has a fork (6) comprising at least two fork arms (14, 15) which are mutually offset in a height direction (y) of the needle (1) and extend beside each other in the longitudinal direction (x), wherein at least one of the at least two fork arms (14, 15) is configured to guide the slider (2) during relative movement between the needle (1) and the slider (2), wherein the slider (2) has at least one functional element (8) which limits relative movement between the needle (1) and the slider (2), and wherein the needle (1) comprises a lateral surface extending in the longitudinal direction (x) and the height direction (y), wherein the lateral surface comprises at least one enclosed hole (7) into which the at least one functional element (8) of the slider (2) extends, wherein the at least one enclosed hole (7) comprises an uninterrupted boundary defined by the lateral surface.

2. The compound needle (13) according to claim 1, wherein the at least one hole (7) is an oblong hole or a groove.

3. The compound needle (13) according to claim 1, wherein the at least one hole (7) extends in the longitudinal direction (x) for at least a distance which substantially matches a maximum relative movement (25) between the needle (1) and the slider (2) in the longitudinal direction (x).

4. The compound needle (13) according to claim 1, wherein the needle (1) includes an upper belt portion (10) extending above the at least one hole (7) and a lower belt portion (9) extending below the at least one hole (7), wherein the upper belt portion (10) has a width in a width direction (z) of the needle (1) that is narrower than a width of the lower belt portion.

5. The compound needle (13) according to claim 1, wherein the at least one functional element (8) is a tab which is attached to a skirt (18) of the slider (2), wherein the skirt (18) embraces the needle and is oriented such that the tab extends into the at least one hole (7).

6. The compound needle (13) according to claim 1, wherein the at least one functional element (8) comprises at least one notch (12).

7. The compound needle (13) according to claim 1, wherein the at least one functional element (8) comprises at least one cylindrical stud (21), an axis of said at least one cylindrical stud (21) extending in a width direction (z) of the needle (1).

8. The compound needle (13) according to claim 1, wherein the at least one functional element (8) has a surface (22) which faces in a width direction (z) of the needle (1) and is inclined by an assembly angle (27) away from a plane defined by the height direction (y) and the longitudinal direction (x) when the at least one functional element (8) is in an operative position.

9. The compound needle (13) according to claim 1, wherein the at least one hole (7) is an oblong hole, wherein the slider (2) comprises at least two functional elements (8), which are mutually offset in a width direction (z) of the needle (1), and wherein each of the at least two functional elements (8) is positioned within the oblong hole (7) on opposing sides thereof.

10. The compound needle (13) according to claim 1, wherein the needle (1) comprises a needle butt (17) and/or the slider (2) comprises a slider butt (19), wherein the needle butt (17) and/or the slider butt (19) are each configured to be driven by a knitting-machine.

11. The compound needle (13) according to claim 1, wherein the fork (6) and the at least one hole (7) do not overlap in the longitudinal direction (x).

12. The compound needle (13) according to claim 1, wherein between an end of a portion (34) taken up by the fork (6) in the longitudinal direction (x) and a beginning of a portion (35) taken up by the at least one hole (7) in the longitudinal direction (x), a gap (20) exists, which measures at least as much in the longitudinal direction (x) as a maximum dimension of an upper fork arm (14) of the at least two fork arms (14, 15) in the height direction (y).

13. The compound needle (13) according to claim 4, wherein an undermost bounding surface (37) of the lower belt portion (9) is a same height, in the height direction (y), as an undermost bounding surface (38) of the needle (1) or forms a part of the undermost bounding surface (38) of the needle (1).

14. The compound needle (13) according to claim 4, wherein in a plane defined by the height direction (y) and the width direction (z) of the needle (1), a cross-sectional area (Ao) of the upper belt portion (10) is smaller or the same as a cross-sectional area (Au) of the lower belt portion (9).

* * * * *